US008220551B2

(12) United States Patent
Fenton

(10) Patent No.: US 8,220,551 B2
(45) Date of Patent: Jul. 17, 2012

(54) SUBSEA TOROIDAL WATER SEPARATOR

(75) Inventor: Stephen P. Fenton, Balmedie (GB)

(73) Assignee: Vetco Gray Inc., Houston, TX (US)

( * ) Notice: Subject to any disclaimer, the term of this patent is extended or adjusted under 35 U.S.C. 154(b) by 537 days.

(21) Appl. No.: 12/430,195

(22) Filed: Apr. 27, 2009

(65) Prior Publication Data

US 2009/0266550 A1 Oct. 29, 2009

Related U.S. Application Data

(60) Provisional application No. 61/048,030, filed on Apr. 25, 2008.

(51) Int. Cl.
*E21B 43/36* (2006.01)

(52) U.S. Cl. ..... 166/357; 166/344; 166/347; 166/351; 166/368; 166/267; 210/767

(58) Field of Classification Search ..... 166/335, 166/338, 339, 341, 344, 347, 351, 357, 368, 166/369, 378–380, 265, 267, 75.12; 210/512.1, 210/512.2, 513, 532.1, 695, 748.01, 767, 210/787, 800

See application file for complete search history.

(56) References Cited

U.S. PATENT DOCUMENTS 3,504,741 A * 4/1970 Talley, Jr. et al. ..... 166/356
3,516,490 A * 6/1970 Waguespack et al. ..... 166/357
4,241,787 A 12/1980 Price
4,424,068 A 1/1984 McMillan
4,438,817 A * 3/1984 Pokladnik et al. ..... 166/341
4,626,237 A * 12/1986 Galloway, Jr. ..... 494/37
5,004,552 A * 4/1991 Al-Yazdi ..... 210/789
5,232,475 A * 8/1993 Jepson ..... 95/260
5,570,744 A * 11/1996 Weingarten et al. ..... 166/357
5,698,014 A * 12/1997 Cadle et al. ..... 96/157
6,033,567 A 3/2000 Lee et al.
6,367,547 B1 4/2002 Towers et al.
6,550,535 B1 4/2003 Traylor (Continued)

FOREIGN PATENT DOCUMENTS

WO WO03/007893 9/2003

OTHER PUBLICATIONS

John A. Veil, Interest revives in downhole oil-water separators, Oil and Gas Journal, Feb. 16, 2001, vol. 99, issue 9.

*Primary Examiner* — Thomas Beach
*Assistant Examiner* — Matthew Buck
(74) *Attorney, Agent, or Firm* — Bracewell & Giuliani LLP

(57) ABSTRACT

A compact, low footprint water separation system for use in subsea well operations. A subsea production tree has a vertical passage and at least one laterally extending branch. A subsea gravity separation device having a hollow toroidal body detachably is mounted around and connected to the production tree. An inlet on a first side portion of the separation device is connected to the at least one laterally extending branch of the production tree and admits production fluid. The production fluid flows through the separation device where it passes through a separation unit. After passing through a separation unit, less dense fluid is discharged through an upper outlet and more dense fluid is discharged through a lower outlet. The upper and lower outlets are positioned opposite the first side portion of the separation device.

16 Claims, 6 Drawing Sheets

U.S. PATENT DOCUMENTS

| | | | | |
|---|---|---|---|---|
| 6,637,514 | B1 | 10/2003 | Donald | |
| 6,681,850 | B2 * | 1/2004 | Bartlett et al. | 166/86.2 |
| 6,832,874 | B2 * | 12/2004 | Appleford et al. | 405/189 |
| 6,966,383 | B2 * | 11/2005 | Milberger et al. | 166/368 |
| 7,048,058 | B2 * | 5/2006 | Ostergaard | 166/339 |
| 7,048,060 | B2 * | 5/2006 | Ostergaard | 166/357 |
| 7,069,988 | B2 * | 7/2006 | Bartlett et al. | 166/86.2 |
| 7,096,937 | B2 * | 8/2006 | Bartlett et al. | 166/86.2 |
| 7,111,687 | B2 | 9/2006 | Donald et al. | |
| 7,134,498 | B2 * | 11/2006 | Hopper | 166/357 |
| 7,175,748 | B2 * | 2/2007 | Michaelsen et al. | 204/547 |
| 7,201,229 | B2 * | 4/2007 | White et al. | 166/368 |
| 7,240,736 | B2 * | 7/2007 | Fenton et al. | 166/358 |
| 7,314,559 | B2 * | 1/2008 | Hopper | 210/512.1 |
| 7,363,982 | B2 * | 4/2008 | Hopper | 166/357 |
| 7,490,671 | B2 * | 2/2009 | Gramme et al. | 166/357 |
| 7,516,794 | B2 * | 4/2009 | Gramme et al. | 166/357 |
| 7,520,989 | B2 * | 4/2009 | Ostergaard | 210/512.1 |
| 7,686,086 | B2 * | 3/2010 | Brammer | 166/357 |
| 7,906,003 | B2 * | 3/2011 | Michaelsen et al. | 204/547 |
| 8,002,121 | B2 * | 8/2011 | Berard et al. | 210/533 |
| 2004/0251030 | A1 * | 12/2004 | Appleford et al. | 166/357 |
| 2007/0138085 | A1 * | 6/2007 | Biester | 210/512.1 |

* cited by examiner

Fig. 4
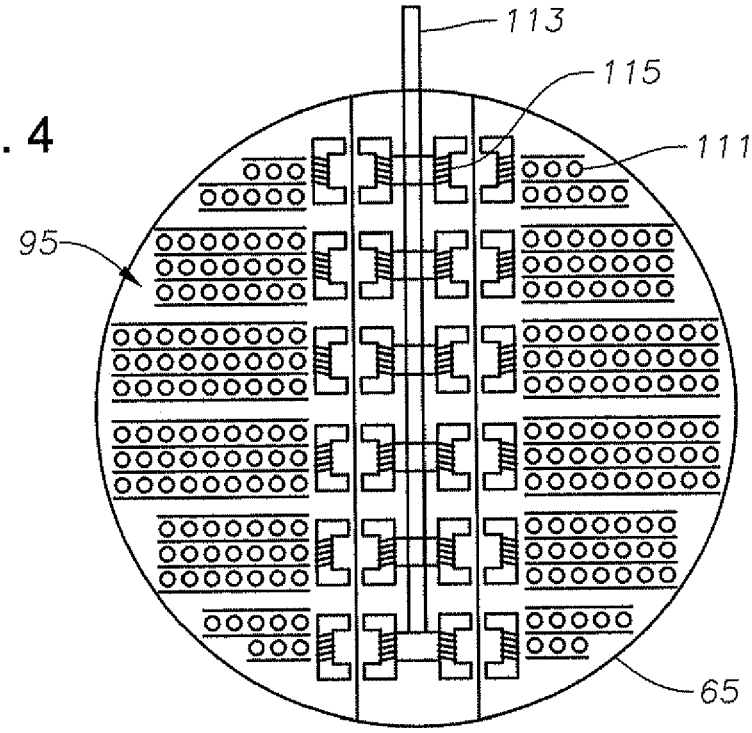
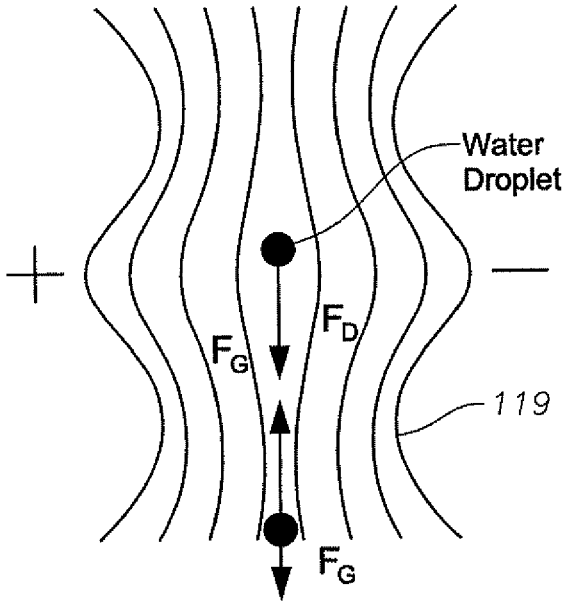
Fig. 5
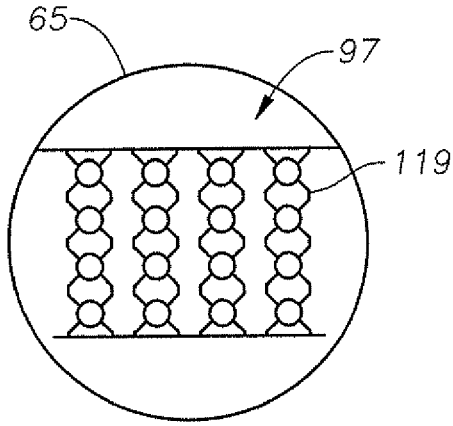
Fig. 6

SUBSEA TOROIDAL WATER SEPARATOR

CROSS-REFERENCE TO RELATED APPLICATION

This application claims priority to provisional application 61/048,030, filed Apr. 25, 2008.

FIELD OF THE INVENTION

This disclosure relates to a water separator, and in particular, to a toroidal water separator for subsea well operations.

BACKGROUND OF THE INVENTION

Oil and gas wells typically produce a well fluid that requires separation to remove formation water from the flow stream. With subsea wells, the separation typically takes place on a production platform or vessel. This usually requires pumping the well fluid, including the formation water, to the surface production facility. In deep water installations, thousands of feet deep, the energy required to pump the water is extensive.

Locating the separation unit subsea has been proposed and done on at least one occasion. The environment of a subsea separation unit and a surface unit differs because of the high hydrostatic forces imposed on the separation vessels. While vessels can be made stronger, generally this results in larger size and weight. Large size and weight increase the difficulty of deploying the units.

Also, separators commonly require maintenance because of sand accumulation and mineral deposits on the components. Once installed subsea, maintenance becomes difficult because of the sea depths. Further, shutting down a separation system for maintenance would normally require shutting off well flow, which is expensive. A need exists for a technique that addresses the emphasis on increasing the reservoir recovery factor for subsea well operations by separation of water from produced hydrocarbons. A new technique in necessary to provide a compact, low footprint separator is desirable for efficient system upgrades through field life with minimal upfront investment. The following technique may solve one or more of these problems.

SUMMARY OF THE INVENTION

A compact, low footprint water separation system is provided for use in subsea well operations. The separation system is designed to connect to a subsea production tree with a vertical passage and at least one laterally extending branch. The subsea gravity separation device has a hollow toroidal body and is adapted to be detachably mounted around and connected to the production tree. An inlet on a first side portion of the separation device is connected to the laterally extending branch of the production tree and admits production fluid.

The production fluid flows through the separation device where it passes through a separation unit. In one embodiment, the separation unit comprises at least one dielectrophoresis unit and at least one coalescent separation unit located within the toroidal body. In an alternate embodiment, the separation unit comprises at least one magnetostatic coalescent unit.

After passing through a separation unit, the production fluid is separated into more dense fluid and less dense fluid, with the less dense fluid floating atop the more dense fluid within the separation device. The less dense fluid is discharged through an upper outlet and more dense fluid is discharged through a lower outlet. The upper and lower outlets are positioned opposite the first side portion of the separation device.

BRIEF DESCRIPTION OF THE DRAWINGS

FIG. 4 is an enlarged schematic section view of the separator of FIG. 3, taken along the line 4-4 of FIG. 3, illustrating the coalescence separator portion.

FIG. 5 is an enlarged schematic view of a dielectrophoresis separator portion of the separator of FIG. 3.

FIG. 6 is an enlarged schematic view of the separator of FIG. 3, taken along the line 6-6 of FIG. 3, illustrating the dielectrophoresis separator portion.

DETAILED DESCRIPTION OF THE INVENTION

Figure 1:
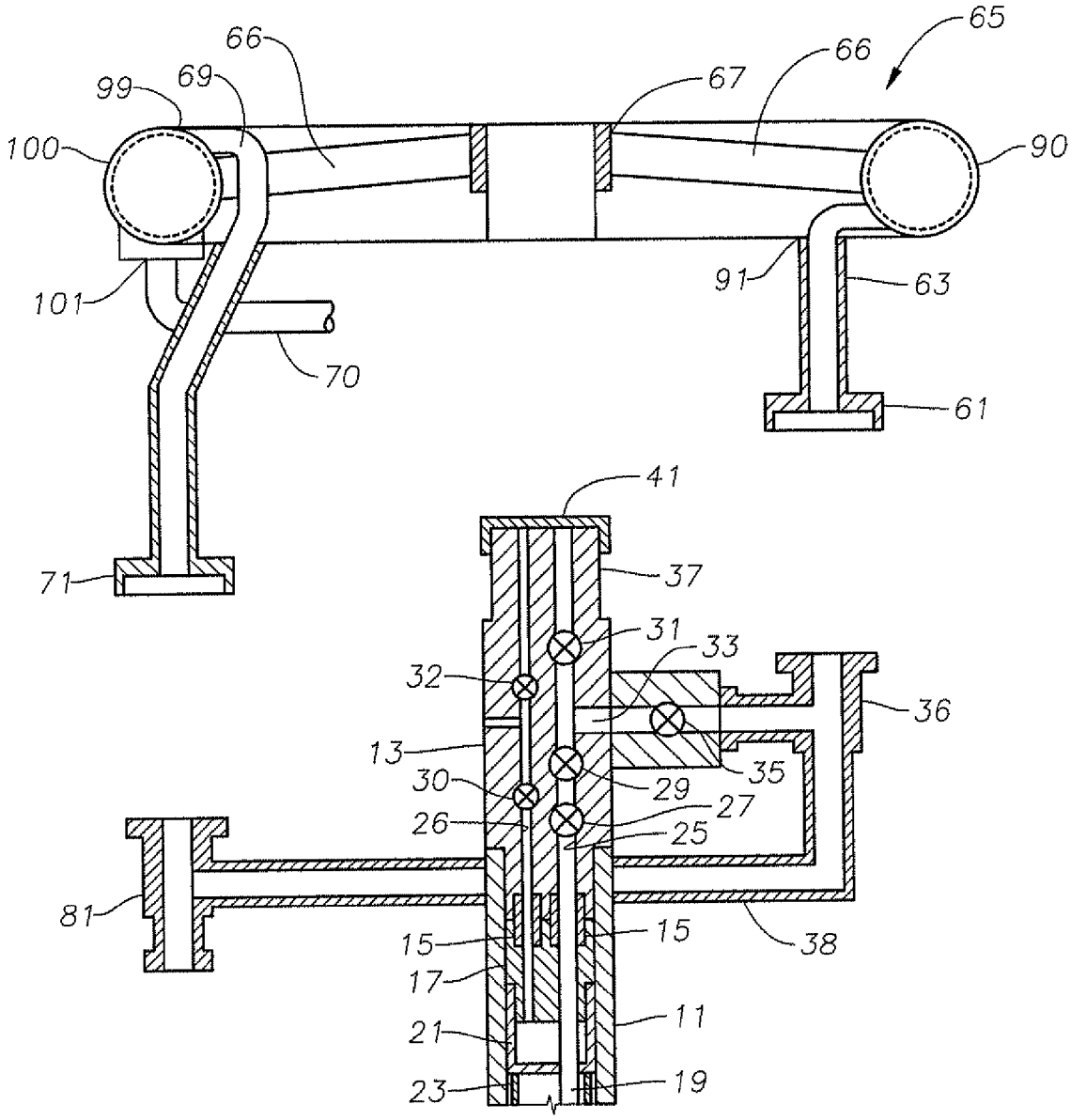
FIG. 1 is a schematic view of a conventional subsea wellhead assembly and a toroidal water separator positioned above.

Referring to FIG. 1, a wellhead housing 11 is located at the upper end of a subsea well. Wellhead housing 11 is a large tubular member mounted to a conductor pipe that extends to a first depth in the well. A subsea Christmas or production tree 13 is secured to the upper end of wellhead housing 11 by a conventional connector. In this embodiment, tree 13 has isolation tubes 15 that extend downward into sealing engagement with the production and annulus bores of a tubing hanger 17. Tubing hanger 17 supports a string of production tubing 19 that extends into the well and is located sealingly in wellhead housing 11. At least one casing hanger 21 is supported in wellhead housing 11, each casing hanger 21 being secured to a string of casing 23 that extends into the well and is cemented in place.

Tree 13 has an axially extending production bore 25 that communicates with one isolation tube 15 and extends upward through the tree. An annulus bore 26 communicates with the other isolation tube 15 and extends through tree 13 for communicating the annulus surrounding tubing 19. Production bore 25 has at least one and preferably two master valves 27, 29. Annulus valves 30, 32 are conventionally located in annulus bore 26. A swab valve 31 is located in production bore 25 near the upper end of tree 13. A production port 33 extends laterally outward from production bore 25 and joins a production wing valve 35. A production wing valve 35 is connected to a choke body 36 constructed for receiving a choke insert (not shown). Choke body 36 is also able to receive a plug (not shown) normally lowered and retrieved by a wireline. Choke body 36 is connected to production piping 38 which runs from choke body 36 to choke body 81.

Tree 13 also has a mandrel 37 connected on its upper end. Mandrel 37 is a standard reentry mandrel and may be connected to tree 13 by a conventional type of connector clamp (not shown). The clamp may be remotely actuated. A cap 41 is shown located on standard reentry mandrel 37 in this example.

Figure 3:
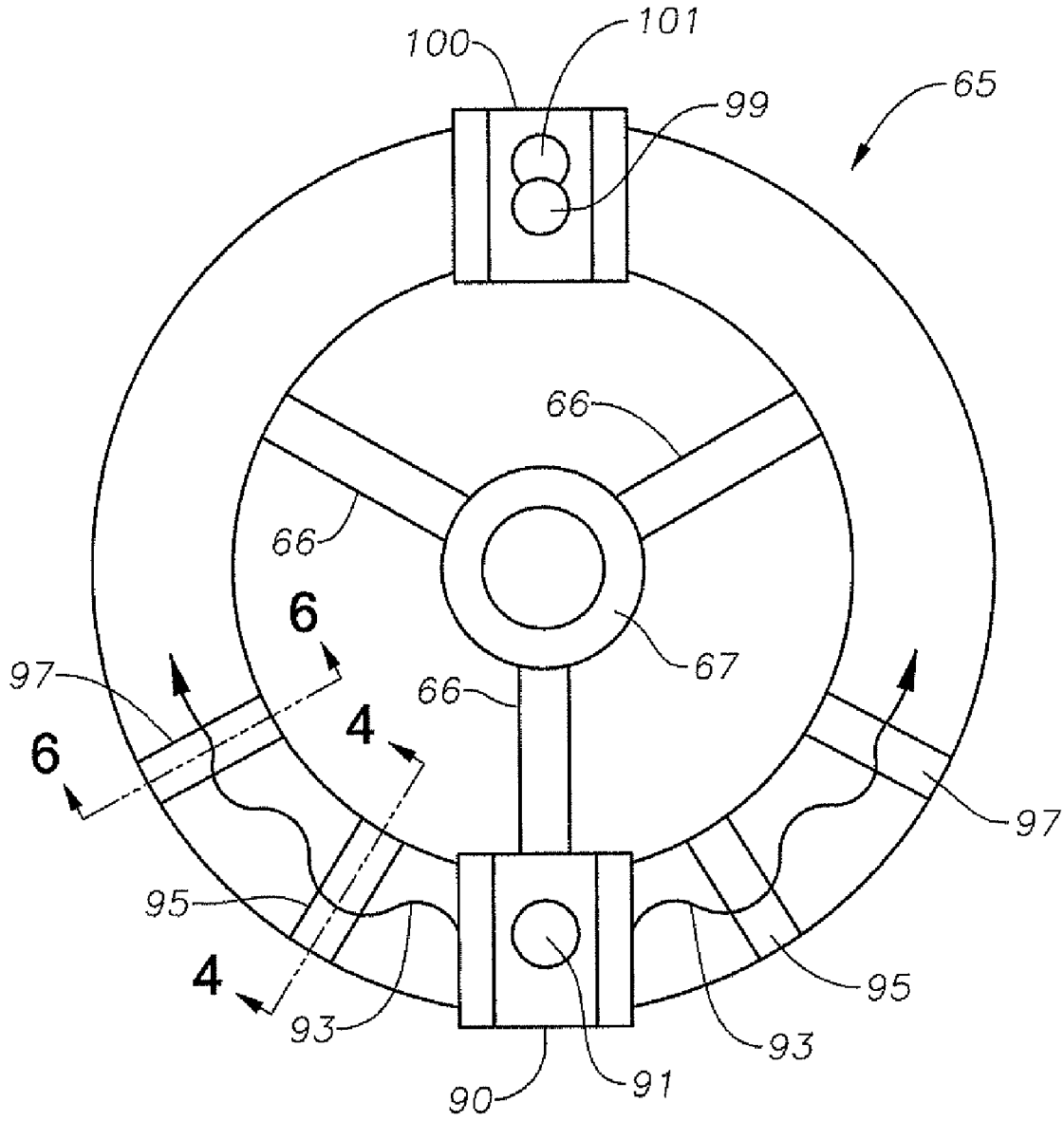
FIG. 3 is a top view of the toroidal water separator of FIG. 2.
Figure 7:
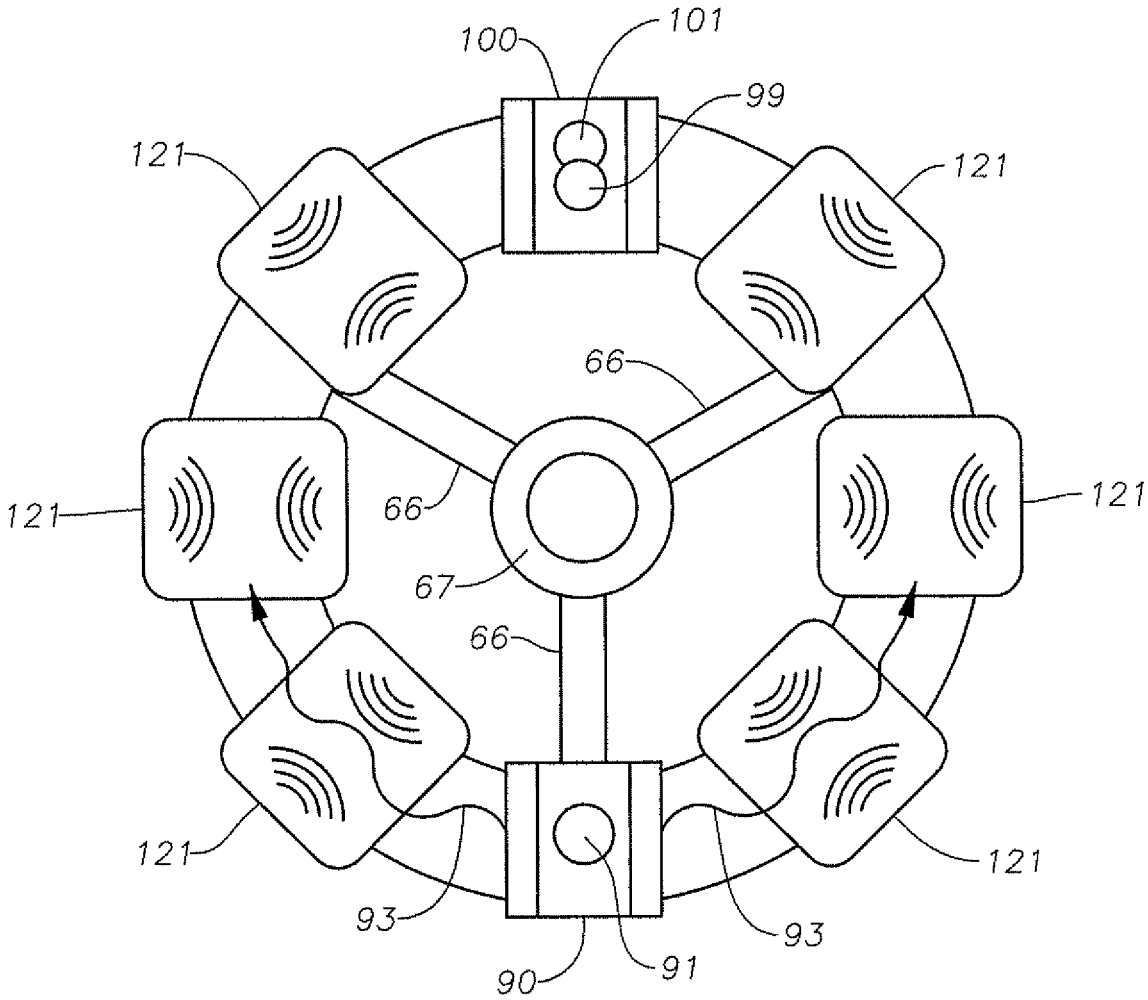
FIG. 7 is a top view of an alternate embodiment of a toroidal separator.

The toroidal separator 65 illustrated is a low footprint water separator system for efficient system upgrade through field life. Separator 65 is a torus shape, with a smaller ring 67 located within the inner circular space formed by the torus. Ring 67 is connected to the torus by way of support arms 66 (FIGS. 3 and 7). Separator 65 has a production fluid or oil and water inlet 91 located on one side 90 of the torus. Production fluid or oil and water flow tube 63 extends from inlet 91 to connector 61. On the opposite side 100 of separator 65 from the inlet 91 are two outlets 99, 101. Less dense fluid or oil outlet 99 is located on the top of separator 65 and is connected to a less dense fluid or oil flow tube 69. Flow tube 69 extends from less dense fluid or oil outlet 99 to connector 71. More dense fluid or water outlet 101 is located on the bottom of separator 65 and is connected to more dense fluid or water flow tube 70. Flow tube 70 carries the more dense fluid (i.e., separated water) away from separator 65.

Figure 2:
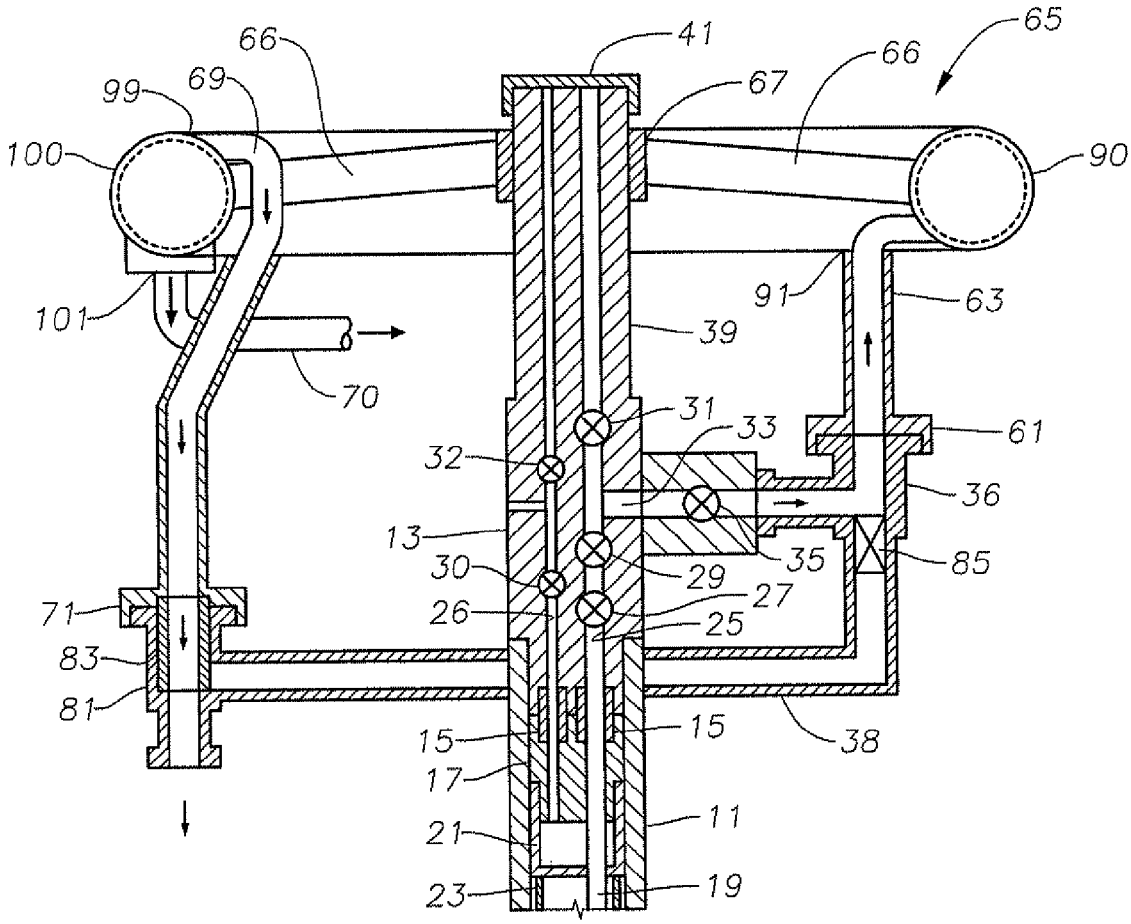
FIG. 2 is a schematic view of the toroidal water separator of FIG. 1 landed on the subsea wellhead assembly of FIG. 1.

Referring to FIG. 2, in order to allow for the implementation of separator 65 to the tree 13, standard reentry mandrel 37 is replaced with an extended reentry mandrel 39. The mandrel 37 is disconnected and a longer mandrel 39 is connected to tree 13 on a wire assisted by remote operated vehicle (ROV) operation of the connector clamp (not shown). Alternatively, the tree 13 may be supplied with the longer mandrel 39 in the first instance. Extended mandrel 39 may comprise an annular profile, such as a set of exterior grooves, for connection to water separator 65. The grooves on the mandrel 39 correspond to offset axial grooves or splines along the inside diameter of ring 67. The axial grooves of ring 67 would slidingly engage the axial grooves of mandrel 39 and ensure that separator 65 could not rotate around the vertical axis of mandrel 39. A tree cap or debris cap 41 is shown located on extended reentry mandrel 39 in this example. It is desired to position separator 65 as close as possible to the axis of tree 13. However, in order to maintain vertical access to tubing 19, separator 65 is not located on the vertical axis of passage 25. Rather, ring 67 acts as a collar that slides down and around the vertical axis of extended mandrel 39.

A connector 61 connects oil and flow tube 63 to choke body 36. Connector 61 is preferably a type that is remotely actuated with assistance of an ROV. Plug 85 is inserted into choke body (or flow tee) 36 to direct the production flow to the separator 65. As shown on the left hand side of the tree, flow tube 69 has a downward extending portion with a tubular seal sub 83 that is in stabbing and sealing engagement with the bore in choke body (or flow tee) 81, thereby isolating flow from the tree piping that transmits flow in the absence of the separator. Preferably outlet flow tube 69 is slightly flexible or compliant for stabbing seal sub 83 into choke body 81. A connector 71 connects oil flow tube 69 to choke body 81. Connector 71 is preferably a type that is remotely actuated with the assistance of an ROV.

In one type of operation of the FIG. 2 embodiment, more dense fluid (i.e., water) is sought to be separated from the production fluid (i.e., oil and water) flow at the tree 13. Operating the toroidal water separator 65 of FIG. 2 comprises closing valves 27, 29, 31 and 35 and removing the standard reentry mandrel 37 and tree cap or debris cap 41. Then removing the choke insert from choke body 36, and inserting plug 85 into choke body 36 in order to isolate the production flow from redundant piping 38. The subassembly comprising extended reentry mandrel 39, tree cap 41, and separator 65 is lowered, preferably on a lift line. With the assistance of an ROV, the extended mandrel 39 is inserted. The separator 65 is then lowered onto extended mandrel 39 and seal sub 83 sealingly stabs into choke body 81. The ROV connects connector 71 to choke body (or flow tee) 81 and connector 61 to choke body (or flow tee) 36. A downward force due to the weight of separator 65 passes through extended mandrel 39 and tree 13 into wellhead housing 11. Preferably, no component of the downward force due to the weight of separator 65 passes to choke bodies/flow tees 36, 81.

Alternatively, for example, in shallow waters where the time and costs to recover are relatively insignificant, the tree may be recovered to the surface and converted into an "integrated separator" prior to reinstallation via conventional methods. Another example may be in cases where a tree has been in service for a number of years. In this example, the tree may also be recovered to the surface and converted into an "integrated separator" prior to re-installation via conventional methods.

After installation, valves 27, 29, and 35 are opened, causing flow to travel through production port 33 and into choke body (or flow tee) 36. The flow continues through flow tube 63 and enters into the separator 65 through oil and water inlet 91 located on one end 90 of the separator 65. Separator 65 operates to separate water out from the production flow.

Referring to FIG. 3, once the oil and water flow enters separator 65 through inlet 91 on one end 90 of the separator, the flow continues into both halves of separator 65 as illustrated by flow paths 93. In this embodiment, separator 65 employs coalescent units 95. FIG. 4 shows the large number of separate passages 111 located within torus separator 65 that define the coalescer elements. An electrostatic field is applied to the oil and water mixture at the elements 111. By exposing the mixture of water and oil to an electrostatic field, the dipolar water droplets contained in the oil phase will be oriented in a way that makes them collide or coalesce with each other. This causes the water droplets to grow to bigger droplets. Generally, bigger droplets move and separate faster than smaller droplets. Consequently, a first separation from water and oil takes place in coalescent units 95.

As shown in FIG. 4, preferably low voltage supplied subsea is routed through low voltage wires 113 into the interior of separator 65. A plurality of transformers 115 transform the low voltage to relatively higher voltage that is required for providing the electrostatic field.

The flow passes through coalescent unit 95, and then travels through a second stage of separation. The second stage, in this embodiment, is a dielectrophoresis unit 97, but could comprise a coalescent unit. Unit 97 also uses an electrostatic field, but the coalescing elements are geometrically configured to force the water droplets into designated sections of the separator 65 and thereby form focused streams of water. Electrode sheets 119, as shown in FIGS. 5 and 6, have undulations. Electrode sheets 119 are closely spaced and arranged with constrictive portions where two valleys are separated by the widened portions where two peaks are spaced across from each other. Sheets 119 force the water droplets to move towards the stronger section of the electrostatic field with stronger field gradients. The forces imposed by the gradient field are in the order of magnitude two to five times the gravity force. This phenomenon is used to guide the water droplets into these predetermined sections, where they form continuous streams of separated water for use in separation.

After the flow passes through unit 97, the water that drops out from the oil and water mixture will be traveling on the bottom portion of separator 65, and the oil flow will be traveling on the top portion of separator 65. The separated water will leave the separator through outlet 101 located on the bottom of separator 65, on end 100 opposite inlet end 90. Referring to FIG. 2, the water then travels through water flow tube 70. Water flow tube 70 carries the water away from separator 65 where it can be re-injected or may be discharged to the sea. The oil flow exits the separator through outlet 99 located on the top of separator 65, on end 100 opposite inlet end 90. The oil flow then travels through flow tube 69 and downstream through choke body (or flow tee) 81. Choke body 81 connects to further tubing for production such as a well jumper or manifold.

If it is necessary to remove separator 65 for maintenance, an operator closes valves 27, 29 and 35 and disconnects connector 61 from choke body 36. The operator disconnects connector 71 from choke body 81 then retrieves the assembly of separator 65. After repair or replacement, the operator lowers the assembly and reconnects it in the same manner.

For various reasons, it may be desirable to run instruments and tools by coiled tubing or wireline into production tubing 19. This can be done without removing water separator 65 by removing debris cap 41 from extended reentry mandrel 39 and connecting a riser to mandrel 39. With valves 27, 29, and 31 open, the wireline or coiled tubing tools and instruments can be lowered through the riser and into tubing 19.

FIG. 7 shows an alternate embodiment of a toroidal water separator fitted with magnetostatic coalescent units 121. Magnetostatic coalescent units 121 could optionally be mounted internally or externally to the separator vessel. Externally mounted units 121 are separately recoverable on a wire with ROV assistance. Coalescent unit 121 uses magnetic fields to separate the water from the oil and water flow, and may be assisted by additives introduced into the fluid at or in proximity to the separator inlet 91, in order to provide a catalyst and improve efficiency of separation.

Figure 8:
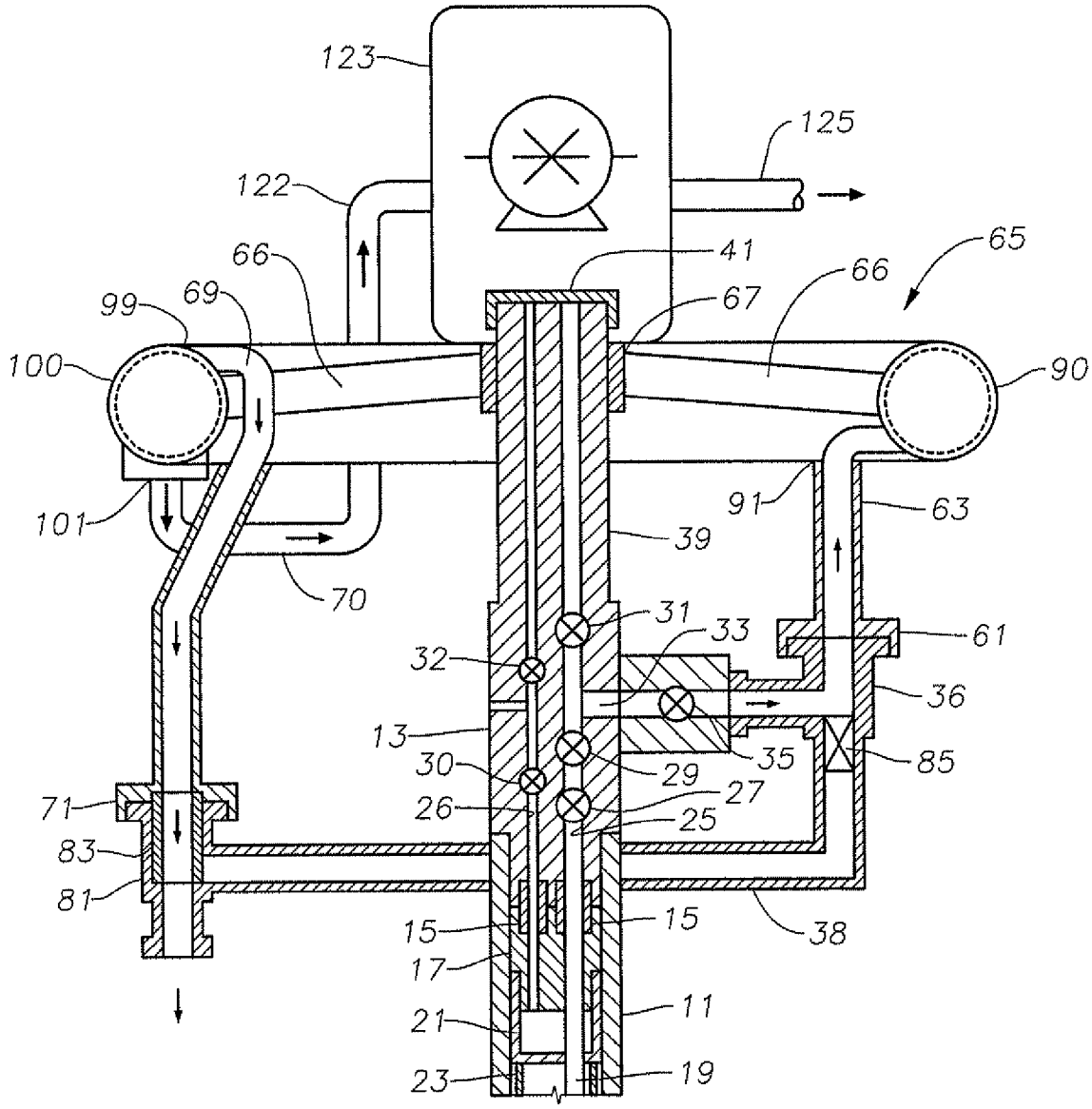
FIG. 8 is a schematic view of a subsea well assembly of FIG. 2 with a pump module installed.

Referring to FIG. 8, water separator 65 could also operate in combination with an electrical submersible pump 123. Pump 123 could be connected as an integral part of separator 65 or could be mounted atop separator 65 on mandrel 39. Pump 123 allows the water from separation unit 65 to travel through flow tubes 70, 122 and into pump 123. The pump could then pump the water out of flow tube 125. Flow tube 125 would allow the separated water leaving pump 123 to be re-injected to an adjacent well or to continue on to a separator or similar device for further processing.

The invention has significant advantages. Supporting the subsea separator and pump by the mandrel of the tree utilizes the structural capacity of the well system, avoiding the need for specially installed dedicated support structures for the separation system. The separator and pump assembly can be readily installed and retrieved for maintenance. The assembly allows access to the tree tubing and tubing annulus for workover operations.

While the invention has been shown in only a few of its forms, it should be apparent to those skilled in the art that it is not so limited but is susceptible to various changes without departing from the scope of the invention.

The invention claimed is:

1. A water separation system for use in well operations, the water separator comprising:

a subsea production tree having a vertical passage with at least one laterally extending production branch, the tree having a mandrel on its upper end;

a subsea separation device having a hollow toroidal body and a central mounting ring connected to the body by a central framework, the ring sliding over and being coupled to the mandrel such that the tree supports the entire weight of the subsea separation device, the toroidal body having an inlet for admitting production fluid, a less dense outlet for discharging less dense fluid, and a more dense outlet for discharging more dense fluid the less dense, outlet and the more dense outlet being located 180 degrees from the inlet relative to an axis of the mounting ring;

the toroidal body having a first separator passage leading from the inlet to the less dense outlet and the more dense outlet in a clockwise direction relative to the axis;

the toroidal body having a second separator passage leading from the inlet to the less dense outlet and the more dense outlet in a counterclockwise direction relative to the axis;

at least one separation unit mounted in each of the separator passages, wherein the production fluid entering the inlet simultaneously flows from the inlet into both of the separator passages and through the at least one separation unit in each of the separator passages; and the at least one laterally extending production branch leads from the vertical passage to the separation device for admitting the production fluid.

2. The water separator of claim 1, wherein the production fluid inlet and the more dense fluid outlet are positioned on a lower side portion of the toroidal body, and the less dense fluid outlet is positioned on an upper side portion of the toroidal body.

3. The water separator of claim 1, wherein the tree further comprises a first upward-facing receptacle connected to the at least one laterally extending branch; and wherein the subsea separation device further comprises an inlet tube extending from the inlet of the toroidal body that stabs into the first upward-facing receptacle to admit fluid therethrough when the separation device is mounted to the tree.

4. The water separator of claim 3, wherein the tree further comprises a second upward-facing receptacle connected to the at least one laterally extending branch, opposite the first upward-facing receptacle; and wherein the subsea separation device further comprises an outlet tube extending from the less dense outlet of the toroidal body that stabs into the second upward-facing receptacle to discharge fluid therethrough when the separation device is mounted to the tree.

5. The water separator of claim 3, wherein the tree further comprises a second upward-facing receptacle connected to the at least one laterally extending branch, opposite the first upward-facing receptacle, the first and second receptacles connected to one another by a passage, and wherein a plug is inserted into the passage to block flow between the first and second receptacles; and wherein the subsea separation device further comprises an outlet tube extending from the less dense outlet of the toroidal body that stabs into the second upward-facing receptacle to discharge fluid therethrough when the separation device is mounted to the tree.

6. The water separator of claim 1, further comprising:

an electrical submersible pump detachably mounted to the subsea production tree, and wherein the more dense fluid outlet is connected to the pump to allow for the more dense fluid to be discharged through the pump.

7. A water separation system for use in well operations, the water separator comprising:

a subsea production tree having a vertical passage with at least one laterally extending production branch;

first and second upward-facing receptacles connected to the at least one laterally extending branch, the second upward-facing receptacle positioned opposite, the first upward-facing receptacle;

a subsea separation device having a hollow toroidal body, the toroidal body having an inlet on a first side portion thereof for admitting production fluid, and a less dense outlet for discharging less dense fluid and a more dense outlet for discharging more dense fluid located opposite the first side portion;

an inlet tube extending from the inlet of the toroidal body that stabs into the first upward-facing receptacle to admit fluid therethrough when the separation device is mounted to the tree; and an outlet tube extending from the less dense outlet of the toroidal body that stabs into the second upward-facing receptacle to discharge fluid therethrough when the separation device is mounted to the tree.

8. The water separator of claim 7, wherein the tree has a mandrel on its upper end; and wherein subsea separation device further comprises:

a central mounting ring connected to the body by a central framework; and wherein the ring slides over and is coupled to the mandrel such that the tree supports the entire weight of the subsea separation device.

9. The water separator of claim 7, wherein the first and second receptacles are connected to one another by a passage, and wherein a plug is inserted into the passage to block flow between the first and second receptacles.

10. The water separator of claim 7, wherein the production fluid flows in two directions after entering the toroidal body.

11. The water separator of claim 7, wherein the production fluid inlet and the more dense fluid outlet are positioned on a lower side portion of the toroidal body, and the less dense fluid outlet is positioned on an upper side portion of the toroidal body.

12. The water separator of claim 7, further comprising:

an electrical submersible pump detachably mounted to the subsea production tree, and wherein the more dense fluid outlet is connected to the pump to allow for the more dense fluid to be discharged through the pump.

13. A water separation system for use in well operations, the water separator comprising:

a subsea production tree having a vertical passage with at least one laterally extending production branch, the tree having a mandrel on its upper end;

a subsea separation device having a hollow toroidal body and a central mounting ring connected to the body by a central framework, the ring sliding over and being coupled to the mandrel such that the tree supports the entire weight of the subsea separation device, the toroidal body having an inlet on a first side portion thereof for admitting production fluid, and a less dense outlet for discharging less dense fluid and a more dense outlet for discharging more dense fluid located opposite the first side portion;

first and second upward facing receptacles connected to the at least one laterally extending branch, the second upward-facing receptacle positioned opposite the first upward-facing receptacle;

an inlet tube extending from the inlet of the toroidal body that stabs into the first upward-facing receptacle to admit fluid therethrough when the separation device is mounted to the tree; and an outlet tube extending from the less dense outlet of the toroidal body that stabs into the second upward-facing receptacle to discharge fluid therethrough when the separation device is mounted to the tree.

14. The water separator of claim 13, wherein the first and second receptacles are connected to one another by a passage, and wherein a plug is inserted into the passage to block flow between the first and second receptacles.

15. The water separator of claim 13, wherein the production fluid inlet and the more dense fluid outlet are positioned on a lower side portion of the toroidal body, and the less dense fluid outlet is positioned on an upper side portion of the toroidal body.

16. The water separator of claim 13, further comprising:

an electrical submersible pump detachably mounted to the subsea production tree, and wherein the more dense fluid outlet is connected to the pump to allow for the more dense fluid to be discharged through the pump.

* * * * *